United States Patent [19]

Wright

[11] 4,012,738

[45] Mar. 15, 1977

[54] COMBINED LAYERS IN A MICROWAVE RADIATION ABSORBER

[75] Inventor: Rufus W. Wright, Alexandria, Va.

[73] Assignee: The United States of America as represented by the Secretary of the Navy, Washington, D.C.

[22] Filed: Jan. 31, 1961

[21] Appl. No.: 86,256

[52] U.S. Cl. ..... 343/18 A

[51] Int. Cl.[2] ..... H01Q 17/00

[58] Field of Search ..... 343/18, 18 A

[56] References Cited

UNITED STATES PATENTS

| | | | |
|---|---|---|---|
| 2,610,250 | 9/1952 | Wheelers | 343/18 A |
| 2,717,312 | 9/1955 | Taylor | 343/18 A |
| 2,769,148 | 10/1956 | Clogston | 343/18 E |
| 2,822,539 | 2/1958 | McMillian | 343/18 A |
| 2,877,286 | 3/1959 | Vance et al. | 343/18 |
| 2,951,247 | 8/1960 | Halpun et al. | 343/18 A |
| 2,956,281 | 10/1960 | McMillian et al. | 343/18 A |
| 2,977,591 | 3/1961 | Tanner | 343/18 A |

*Primary Examiner*—Maynard R. Wilbur
*Assistant Examiner*—Richard E. Berger
*Attorney, Agent, or Firm*—R. S. Sciascia; Philip Schneider; G. J. Crasanakis

EXEMPLARY CLAIM

2. Combined layers in a microwave radiation absorber comprising a layer of dielectric material of relatively high dielectric constant and a layer of magnetic material having a relatively high coefficient of magnetic permeability, said layers being substantially parallel and contiguous to one another and adapted to be positioned at a radiation reflecting surface, said layer of magnetic material being adapted to be contiguous to said reflecting surface, said layers having a thickness approximately a quarter wavelength of microwave radiation as measured within said combined layers.

18 Claims, 7 Drawing Figures

INVENTOR
RUFUS W. WRIGHT

BY Richard C. Reed
ATTORNEY

INVENTOR
RUFUS W. WRIGHT

BY Richard A. Reed

ATTORNEY

COMBINED LAYERS IN A MICROWAVE RADIATION ABSORBER

The invention described herein may be manufactured and used by or for the Government of the United States of America for governmental purposes without the payment of any royalties thereon or therefor.

This invention relates to layers of absorbent materials which are used to absorb incident microwave radiation energy. In particular, the invention is related to layers of absorbent materials which are suitably combined to form novel radiation-absorbing structures.

It has often been found necessary to reduce both the weight and thickness of prior art absorbent layers without imparing their effectiveness and without sacrificing any mechanical strength. Efforts, however, to minimize weight or thickness in absorbent layers have been tantamount to altering desirable electrical properties.

Energy-absorbing arrangements heretofore depended upon a conducting surface layer appropriately spaced from a reflecting surface; other arrangements depended upon a layer having the proper loss tangent throughout the absorbent material. Such arrangements have been based on the properties of a single layer of either a conducting surface or of a high loss material which often lacked the proper balance between electric and magnetic field energy dissipation. High dielectric and magnetic losses were previously combined into a composite layer by incorporating therein particles of another dielectric, magnetic, conducting or semiconducting material, but the ideal match of a properly related dielectric constant to a high complex permeability has not been fully achieved.

The solid ferrites have been found to possess a sufficient complex permeability along with a high enough dielectric constant to provide good broadband absorption, especially at the lower microwave frequencies, but these materials are not suitable in the form of slabs for camouflage because of their weight and fragile nature. Absorbers, on the other hand, which are formed of thin conductive layers require large geometric figures, such as cones, wedges or pyramids that are bulky and difficult to preserve.

Consequently, it is an object of the present invention to provide novel structures as microwave energy absorbers which are capable of absorbing substantial amounts of energy.

Another object of the present invention is to provide lightweight radiation energy absorber structures which utilize absorbent layers more efficiently and in substantially reduced thickness than is possible with prior absorbers.

A further object is to provide an improved microwave radiation energy absorber which is particularly well-suited for low frequency use, as in the early-warning radar systems.

A still further object of this invention resides in the provision of a broadband microwave energy absorber which combines resistive materials of high dielectric constant with materials having a high magnetic permeability more effectively than was possible with the prior art usage of such materials.

Yet another object of this invention refers to suitable camouflage means for transport equipment that provides an electromagnetic energy absorber having improved mechanical strength, compactness and a flat outer surface for minimizing air friction and weathering.

In order to attain the above objects, an electromagnetic wave energy absorber structure is provided in which separate regions are prescribed for a resistive medium characterized by a relatively high dielectric constant and for a magnetic medium characterized by a relatively high coefficient of magnetic permeability. The dielectric medium in the form of a thin layer or film is located in the high electric field region, while the magnetic medium as a thin layer or film is located in the high magnetic field region. The high electric field region is located a distance nearly equal to an odd multiple of a quarter wavelength in front of the object to be shielded, nearest the incoming radiation, and in accordance with the invention provides in that location a thin, high dielectric layer. The high magnetic field region is located behind the electric field region in the space between the dielectric layer and the surface of the object to be shielded. The exact location of the thin magnetic layer in the high magnetic field region is not critical, but it is found advantageous to position it against the surface of the object. Proper matching of loss is adjustable by changing the composition or the thickness of the two layers.

If the resistive material has a very high relative dielectric constant, the amount required for proper thickness is very small, consequently, the resistive material may be utilized in the form of a thin layer or film. Similarly, a very high magnetic permeability in a material enables a thin magnetic layer to provide the broadband feature in the absorber. For some compositions it is also possible to provide matching by inserting a low dielectric layer between the layers of high magnetic permeability and high dielectric constant. More conveniently, an air dielectric or spacing is provided between thin layers, and the air space therein may be filled by a lightweight, low dielectric material, for instance, a rigid polyurethane foam may be used for this purpose.

While the layer arrangements so far described deal with a wide selection of materials with high dielectric or with magnetic properties that may be utilized more effectively and with considerable reduction in the thickness and weight of said layers, it will now be apparent that reduction in layer materials enables the use of intermediate support layers to provide improved lightweight absorber structures. Furthermore, as will be explained further in greater detail, the novel arrangements provide improved microwave absorption in the lower frequency region. The absorber of the present invention may therefore comprise (1) contiguous layers of a high dielectric material and a magnetic material, a quarter wavelength in thickness as measured inside the layers, (2) relatively thin film layers of these materials spaced apart and maintained in a spaced relationship by any convenient means and structures in which (3) the intervening space between the layers is filled with a lightweight, rigid material to provide an intermediate structural support.

The invention may be further explained by the fact that dielectric and magnetic properties can be determined from measurements on electrically thin samples of these materials in equipment such as a coaxial line. The complex dielectric constant and magnetic permeability of these samples can be determined by measuring the voltage standing wave ratio (VSWR) and minimum shift when the sample is properly placed in an electromagnetic field: When an electrically thin layer is placed directly at the short in a line, the minimum shift and voltage standing wave ratio (VSWR) measured depend only on the magnetic properties of the material; when the thin sample is placed a quarter wavelength in front of the short, the corresponding measurements depend only on the dielectric properties of the material. It has now been determined that materials which possess high relative dielectric constants are not effectively utilized in the region near the short. The region near a conducting surface is more effectively utilized by an air space or by a filler material without seriously altering the thickness or the performance of the absorber.

It may now be noted that by combining layers wherein each of the layers possesses either desirable dielectric or magnetic properties into an absorber structure that partakes of the properties of both layers, the amount of materials necessary to provide effective absorption is thereby substantially reduced. Proper matching of dielectric and magnetic properties is more easily achieved by combining layers having distinct high dielectric or magnetic properties. The composite type dielectrics, as mentioned earlier in the specification, are not efficiently utilized because separate portions of said dielectric functioned variably or not at all. In the combined layes described herein, the permeability remains sufficiently high to provide good broadband performance at the lower microwave frequencies of interest. Structural material provided between the thin layers bolsters the mechanical strength of the combined structure without affecting its electrical performance. The combined absorbent and structural layers now present practical panel structures which may be prefabricated and preformed to any surface contour which is to be protected.

In order that the invention may be more clearly understood and readily carried into effect, the same will now be more fully described with reference to the accompanying drawings in which.

Figure 1:
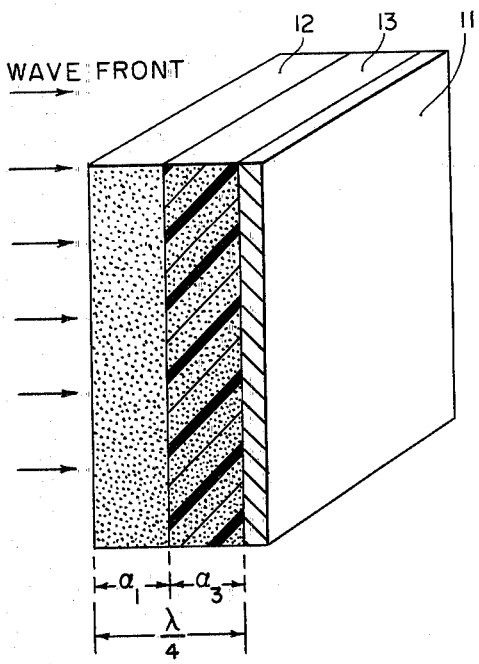
FIG. 1 is a perspective view of one form of the microwave absorber in accordance with the present invention.

Referring now to the drawings and in particular to FIG. 1, there is shown a quarter wavelength absorber comprising an energy reflecting surface 11, which may for instance be any metal surface. In front of the metal surface are two contiguous layers of absorbent materials: the outer surface layer 12 comprises a high resistive composition, which by way of example may be an electrically thin layer of barium titanate ($BaTiO_4$) or other composition having a high dielectric constant, while the inner layer 13 consists of a ferromagnetic dielectric material, such as magnetic metal particles suspended in a suitable dielectric binder. The term "dielectric binder" as employed herein refers to any low dielectric material either organic or inorganic that is suitable as a matrix for holding a dispersion of particles. The magnetic layer may consist therefore of ferromagnetic particles of iron, nickel, permalloy, ferrite, etc. in a dielectric binder such as neoprene, polystyrene, polyethylene and the like. The thickness of the absorber includes the thickness $a_1$ of the high dielectric layer and $a_3$ of the magnetic layer, which together are equal to an odd multiple of a quarter wavelength of the radiation as measured within said layers. The maximum refractive index is usually obtained when the thickness $a_1$ and the thickness $a_3$ each become ⅛ wavelength thick.

Figure 2:
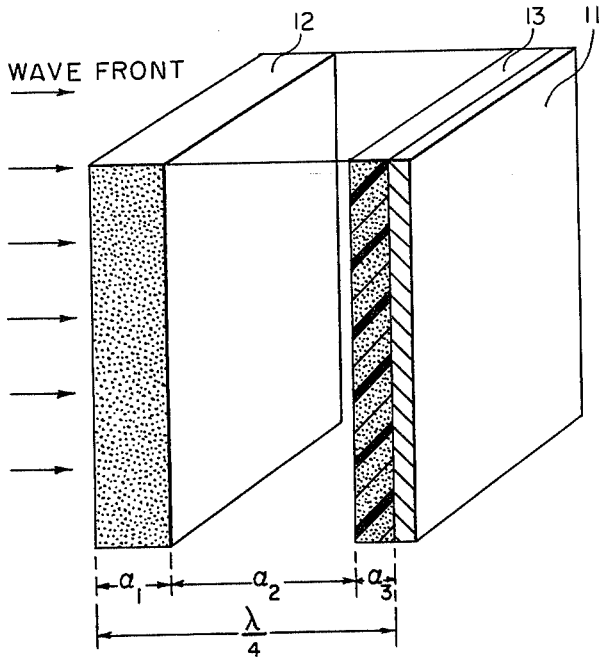
FIG. 2 is a perspective view of another embodiment of the invention showing an air space between absorbent layers.

It frequently is desirable that an absorber be held to a weight minimum while maintaining as broad an absorption band as possible. The embodiment shown in FIG. 2 illustrates a means for achieving a minimum weight arrangement while providing for substantial absorption in the lower microwave frequencies. The resistive layer 12 comprising a thin film of barium titanate ($BaTiO_4$), which has a high relative dielectric constant, is positioned in front of and spaced from a ferromagnetic layer 13 which is attached to the metal surface by any suitable low dielectric adhesive. The layer of barium titanate is positioned a quarter wavelength from the reflecting metal surface, as measured within the absorber layers, while spacer means (not shown) retain it in spaced relation with the inner layer. The combination of said layers and air dielectric represents a reduction in thickness by a factor of 2–3 based on prior art arrangements which do not provide combined layers.

Another example of a combined layer absorber which provides for an air space employs a composite type high dielectric layer. The specific dimensions and compositions to be described are not to be construed as limiting, but are merely illustrative of the types of absorbent layers which may be employed. The high dielectric material consists of a 0.088-inch thick rubber pigmented with aluminum flake. The aluminum flake therein is preferably oriented in the direction of the electrical vector, is present therein in an amount of about 75% of the composite layer by weight and has an average flake thickness of between $3 \times 10^{-5}$ and $2 \times 10^{-4}$ centimeters with the longer flake dimension being about 50 times the average flake thickness. The magnetic layer near the reflecting surface consists of a 0.088-inch thick neoprene with carbonyl iron pigment, the layer consisting of about 20% synthetic rubber impregnated with about 80% carbonyl iron. The iron which is the magnetic additive in the neoprene is obtained by reduction from the carbonyl complex. The dielectric and magnetic layers were tested in a coaxial line to obtain values of their complex dielectric constants and magnetic permeabilities.

Figure 6:
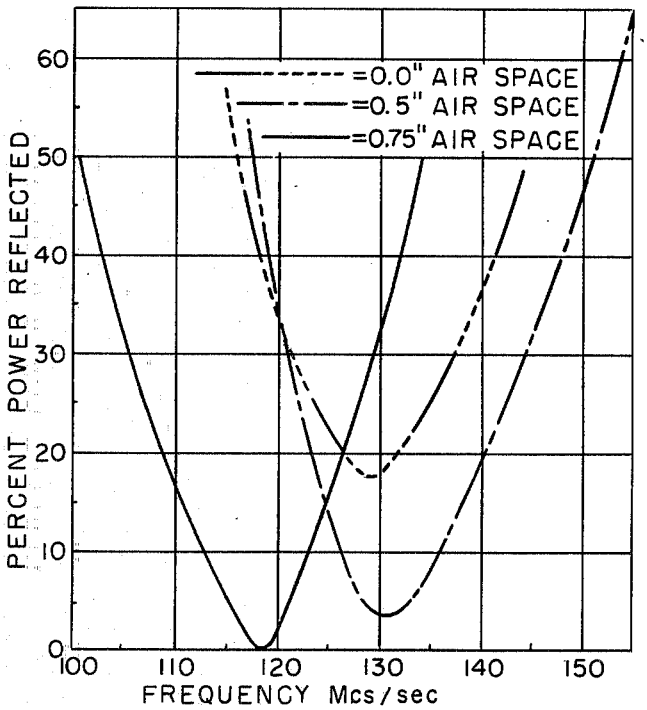

The carbonyl iron-pigmented neoprene had a relative dielectric constant of about 40 and a relative permeability of about 16; the relative dielectric constant of the aluminum loaded rubber layer was about 1600. The two layers were then combined to form an absorber structure without an air spacer, as shown in the embodiment of FIG. 1. This absorber had a very high index of refraction and was also high loss. The addition of varying amounts of an air spacer between the layers of the absorber caused a reduction in the index of refraction and also in the loss tangent, but the combination was nevertheless a good absorber with a relatively high index. FIG. 6 shows the absorption curves of said absorber without an air space and also the same layers spaced ½ inch and ¾ inch apart. It will be apparent from an inspection of FIG. 6 that varying amounts of air space between the layers result in different percent power reflected for the particular absorber combination. Proper spacing between a high dielectric layer and a magnetic layer of given thickness suppresses the reflection of radiant energy at given microwave frequencies, as demonstrated by the graph of FIG. 6. The combination of high dielectric and magnetic layers properly spaced results in a resonant absorber which is substantially non-reflecting to electromagnetic radiation energy of a particular frequency band. Any reflecting surface may be made substantially non-reflecting to any specified microwave frequency by providing an absorber structure with contiguous or spaced layers of a high dielectic and magnetic layers. The absorber so formed will dissipate energy passing through the combined layers and by proper thickness and spacing, the electric and magnetic fields of radiation reflected from the absorber surface will be out of phase with the electric and magnetic fields of the radiation reflected from the reflecting surface and the reflections will be absorbed.

Figure 3:
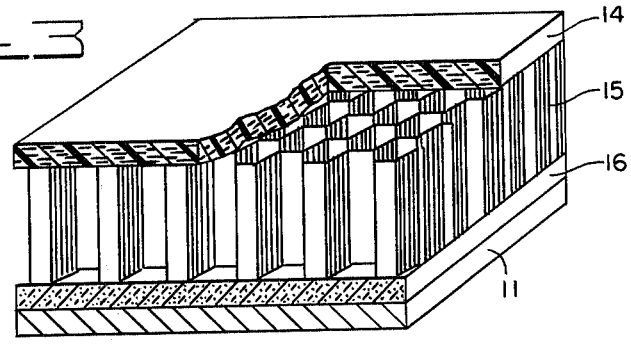
FIG. 3 is a perspective view of another embodiment of the invention showing combined layers partly cut away to expose the rigid honeycomb structure of the intermediate layer.

In another embodiment of the present invention, shown in FIG. 3, the absorber layers are rigidly supported by an intermediate spacer between the high dielectric layer 14 and the magnetic layer 16. The intermediate layer chosen for purposes of illustration is a dielectric honeycomb core 15 having empty cells of any desired dimension. The honeycomb core may be constructed of any rigid, low dielectric composition, for instance a phenolic type honeycomb or a plastic-coated glass cloth fashioned into a honeycomb pattern. A desirable honeycomb absorber panel is constructed by adhering or otherwise fastening a layer of conducting flakes, such as aluminum, copper or silver impregnated in a rubber or plastic matrix to the front face of a phenolic honeycomb. The magnetic layer on the rear face of the honeycomb contains ferromagnetic particles embedded in neoprene. Other rigid, dielectric structural spacers may be used as the intermediate layer, for example, rectangular interlocking strips formed into an egg-crate configuration provides structurally a useful panel support for the absorbent layers.

Figure 4:
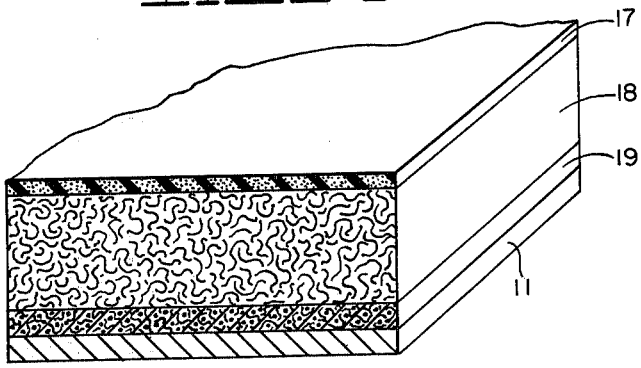
FIG. 4 is a perspective view of another embodiment of the invention showing a rigid polymeric foam between dielectric and magnetic layers.

By proper choice of layers, quarter wavelength thick absorbers may be designed in accordance with the present invention which are especially useful in the early-warning radar frequency ranges. The absorber illustrated in FIG. 4 provides for an intermediate filler 18 between the dielectric layer 17 and magnetic layer 19. The filler is preferably a rigid, lightweight material, as for example a rigid polymeric foam of polyurethane, polystyrene, or phenolformaldehyde. A ferrite composition with a sufficiently high complex permeability below 3000 mcs/sec is used as a thin layer against the metal plate. Ferrites have been proposed as magnetic absorbers, but their application for this purpose has been hampered by the weight factor (specific gravity of nearly 4). In the instant invention the ferrite layer positioned against the reflecting surface is extremely thin and the weight factor is therefore substantially minimized. The absorber is assembled with a carbon-impregnated rubber layer 17 in the dielectric region and a thin layer of ferrite 19 in the magnetic region. The carbon content of the rubber is carefully kept within limits which allows for microwave insertion loss but which maintains a nonconductive layer. Suitable ferrites which are employed as thin sheets are the magnesium-zinc, magnesium-manganese or nickel-zinc mixed types, for example, $(Ni_{0.6}Zn_{0.4})O.Fe_2O_3$. The magnetic properties determine the frequency range in which the absorber is operable; moreover good correlation exists between the ferrite thickness and the variable index of refraction in the lower frequencies of 100 – 1000 mcs/sec whereby the absorber is maintained resonant over a broadband of frequencies.

Figure 7:
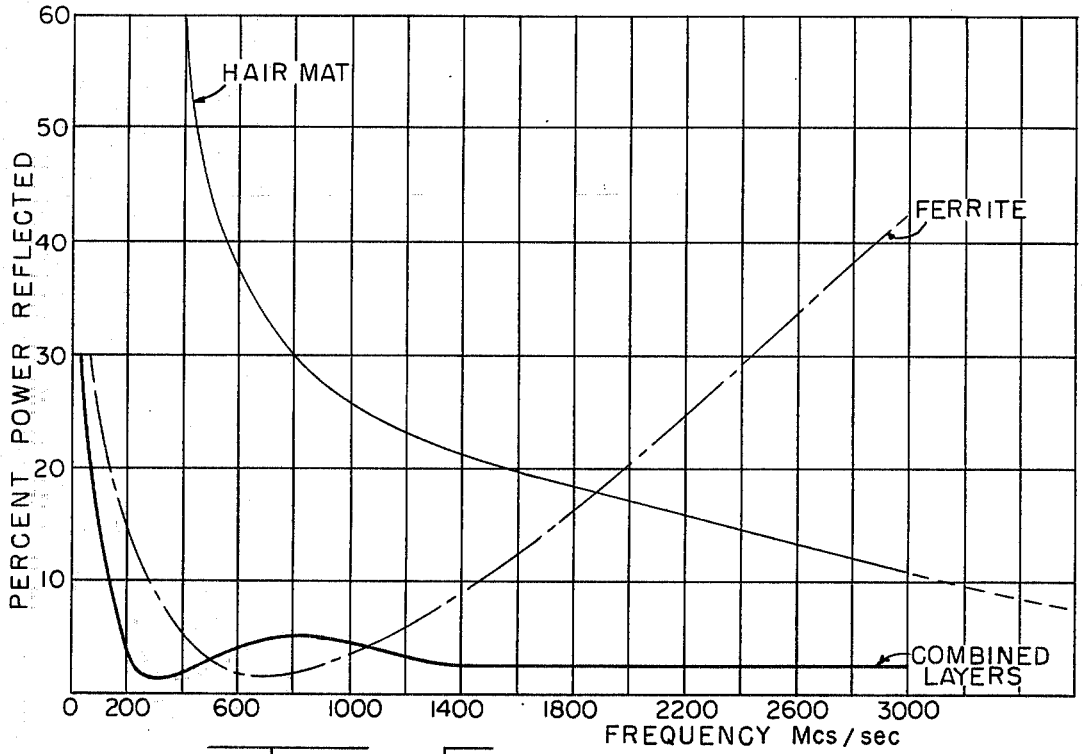
FIGS. 6 and 7 are performance curves of combined layers in absorbers in accordance with the invention.
Figure 5:
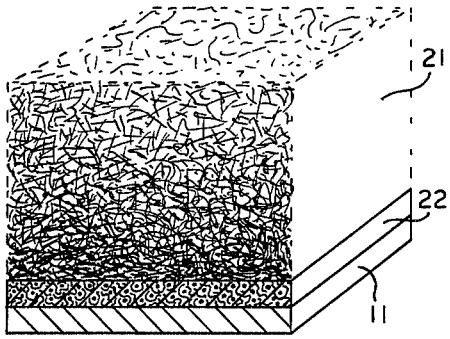
FIG. 5 is a perspective view of a further embodiment showing combined layers of a hair mat and a ferrite.

The above embodiments of the present invention have been described with reference to the structural advantages to be achieved in the novel combinations of high dielectric and magnetic layers, contiguously, in spaced relation or with an intermediate region of suitable rigid fillers. It will now be pointed out that the novel combination of layers also modify and improve the absorption characteristics over a band of frequencies. FIG. 5 illustrates a hair mat layer structure 21 at the front end of the absorber and a ferrite layer 22 in back of the mat in contact with the metal surface 11. The hair mat layer consists of loosely spun animal hair with a carbon-loaded neoprene properly coated on the loose spun hair; the coating on the hair mat surface is made as nearly transparent as possible so that microwave radiation will more easily penetrate the hair mat surface and be absorbed in the interior of the hair mat and ferrite layers. To achieve this end the hair mat is coated stepwise with a carbon and neoprene mixture, applying near the surface a lightly coated region which is progressively increased with coating material, producing thereby a coating gradient from the surface to the base of the hair mat layer. The ferrite layer is preferably a mixed ferrite of sufficient complex magnetic permeability at frequencies of less than 500 mcs/sec, for example a nickel-manganese-zinc ferrite in a suitably thin film size. A specific example provides a hair mat layer 5 inches thick and a ferrite layer approximately ¼ inch thick which are combined to form the absorber illustrated in FIG. 5 whereby good absorption is maintained over a broad band of frequencies. The absorber tested in a coaxial line and a waveguide is found to be capable of dissipating or absorbing a large part of the electromagnetic energy with no more than 5% reflection in the region of 200–3000 mcs/sec and it continues to be a good absorber even above 3000 mcs/sec. FIG. 7 contrasts the performance of the combined absorber layers mentioned in the present embodiment with the performance of each individual layer.

From the foregoing examples it is evident that an electromagnetic wave energy absorber embodying the present invention is most effective to absorption of microwave energy at frequencies below 500 mcs/sec; it may be designed as resonant or with broadband features to be effective at radiation energies in the microwave range below 3000 mcs/sec. Absorber assemblies embodying the invention have the advantage that greater dielectric and magnetic field losses are achieved by increasing both the choice of materials which may be employed as well as providing greater effectiveness for those materials. These features are of importance where it is necessary to obtain a desired degree of absorption in the lower microwave frequency range along with reduction in weight and thickness.

While there have been described what are, at present, considered to be the preferred embodiments of the invention, it will be obvious to those skilled in the art that various changes and modifications may be made therein without departing from the invention, and it is, therefore, aimed in the appended claims to cover all such changes and modifications as fall within the true spirit and scope of the invention.

What is claimed is:

1. Combined layers in a microwave radiation absorber comprising a layer of dielectric material of relatively high dielectric constant and a layer of magnetic material having a relatively high coefficient of magnetic permeability, said layers of dielectric material and magnetic material being in substantially parallel arrangement to one another and adapted to be positioned in a high electric field region and in a high magnetic field region of a radiation reflecting surface, respectively, said layer of magnetic material being adapted to be positioned in said high magnetic field region between said layer of dielectric material and said reflecting surface, said layer of dielectric material having a front surface with respect to the wave front of incident radiation, said front surface being at a distance from said reflecting surface approximately an odd multiple of a quarter wavelength of microwave radiation as measured within said combined layers.

2. Combined layers in a microwave radiation absorber comprising a layer of dielectric material of relatively high dielectric constant and a layer of magnetic material having a relatively high coefficient of magnetic permeability, said layers being substantially parallel and contiguous to one another and adapted to be positioned at a radiation reflecting surface, said layer of magnetic material being adapted to be contiguous to said reflecting surface, said layers having a thickness approximately a quarter wavelength of microwave radiation as measured within said combined layers.

3. Combined layers in a microwave radiation absorber comprising a layer of dielectric material of relatively high dielectric constant and a layer of magnetic material having a relatively high coefficient of magnetic permeability, said layers being substantially parallel and in spaced relationship to one another and adapted to be positioned at a radiation reflecting surface, said layer of magnetic material being adapted to be contiguous to said reflecting surface, said layer of dielectric material having a front surface with respect to the wave front of incident radiation, said front surface being at a distance from said reflecting surface approximately a quarter wavelength of microwave radiation as measured within said combined layers.

4. The combined layers in a microwave radiation absorber according to claim 3 including means for spacing said layer of dielectric material from said layer of magnetic material.

5. Combined layers in a microwave radiation absorber according to claim 3 in which said dielectric material consists of barium titanate and said magnetic material consists of ferromagnetic particles dispersed in a dielectric binder.

6. Combined layers in a microwave radiation absorber comprising a layer of dielectric material of relatively high dielectric constant and a layer of magnetic material having a relatively high coefficient of magnetic permeability, said layers being substantially parallel to one another, an intermediate layer of relatively lightweight filler material of relatively low dielectric constant, said intermediate layer being of uniform thickness and bound on each side thereof by said dielectric and magnetic layers, said layers being adapted to be positioned at a radiation reflecting surface, said layer of magnetic material being adapted to be contiguous to said reflecting surface, said layer of dielectric material having a front surface with respect to the wave front of incident radiation, said front surface being at a distance from said reflecting surface approximately a quarter wavelength of microwave radiation as measured within said combined layers.

7. The combined layers in a microwave radiation absorber according to claim 6 in which said filler material consists essentially of a rigid polyurethane foam.

8. Combined layers in a microwave radiation absorber comprising a layer of dielectric material of relatively high dielectric constant, a layer of magnetic material having a relatively high coefficient of magnetic permeability and an intermediate layer of uniform thickness bound by said dielectric and magnetic layers, said intermediate layer consisting essentially of a relatively lightweight, rigid, cellular structure of relatively low dielectric material, said layers being adapted to be positioned at a radiation reflecting surface, said layer of magnetic material being adapted to be contiguous to said reflecting surface, said combined layers having a thickness approximately a quarter wavelength of microwave radiation as measured within said layers.

9. The combined layers in a microwave radiation absorber according to claim 8 in which the intermediate support layer comprises a honeycomb structure.

10. The combined layers in a microwave radiation absorber according to claim 8 in which said layer of dielectric material consists essentially of aluminum flakes embedded in a rubber matrix.

11. The combined layers in a microwave radiation absorber according to claim 8 in which said magnetic material consists essentially of ferromagnetic particles embedded in neoprene.

12. The combined layers in a microwave radiation absorber according to claim 8 in which said magnetic material consists essentially of a ferrite.

13. A broadband microwave radiation absorber comprising in combination a front layer relative to the wave front composed of aluminum particles embedded in a rubber matrix, an intermediate layer of a rigid honeycomb structure and a back layer composed of carbonyl iron particles embedded in neoprene, said layers having a thickness substantially a quarter wavelength of the radiation measured in said layers.

14. A broadband microwave radiation absorber comprising in combination a front dielectric layer relative to the wave front composed of rubber impregnated with carbon particles, an intermediate layer of rigid polyurethane foam and a back layer of ferrite, said layers having a thickness substantially a quarter wavelength of the radiation measured in said layers.

15. A broadband microwave radiation absorber comprising in combination a front layer relative to the wave front composed of a mat of loosely spun hair coated with a mixture of graphite and rubber and an inner layer of a ferrite composition, said layers having a thickness substantially a quarter wavelength of the radiation measured within said layers.

16. A broadband microwave radiation absorber comprising in combination a front layer relative to the wave front composed of a mat of loosely spun hair coated with a mixture of graphite and rubber, said front layer having a thickness of about 5 inches, and a back layer of ferrite having a thickness of about ¼ inch.

17. Combined layers in a microwave radiation absorber comprising a front layer relative to the wave front of incident radiation, said layer comprising aluminum flakes dispersed in a rubber matrix, said flakes being present therein in an amount of about 75 percent by weight of said layer, said flakes having an average thickness in the range of about $3 \times 10^{-5}$ and $2 \times 10^{-4}$ centimeter and having a long dimension which is about 50 times the average flake thickness, a back layer relative to said wave front comprising carbonyl iron particles dispersed in neoprene, said particles being present therein in an amount of about 80 percent by weight of said layer, and an intermediate layer of air dielectric of about 0.75 inch in thickness.

18. Combined layers in a microwave radiation absorber comprising a front layer relative to the wave front of incident radiation, said layer comprising a plurality of flake-like electrically conductive particles dispersed in a non-conductive binder, a back layer relative to said wave front, said back layer comprising a plurality of ferromagnetic particles dispersed in a non-conductive binder and an intermediate layer of air dielectric, said layers being adapted to be positioned at a radiation reflecting surface, said back layer being contiguous to said surface, said combined layers having a thickness approximately a quarter wavelength of microwave radiation as measured within said layers.

* * * * *